US005147472A

United States Patent [19]

Reichgott

[11] Patent Number: 5,147,472

[45] Date of Patent: Sep. 15, 1992

[54] METHOD FOR SEALING CONVERSION COATED METAL COMPONENTS

[75] Inventor: David W. Reichgott, Richboro, Pa.

[73] Assignee: Betz Laboratories, Inc., Trevose, Pa.

[21] Appl. No.: 647,324

[22] Filed: Jan. 29, 1991

[51] Int. Cl.[5] ..... C23C 22/82

[52] U.S. Cl. ..... 148/255; 148/257

[58] Field of Search ..... 148/247, 248, 250, 255, 148/257, 265, 274

[56] References Cited

U.S. PATENT DOCUMENTS

| | | | |
|---|---|---|---|
| 2,448,397 | 8/1948 | Schilling et al. | 148/255 |
| 3,196,039 | 7/1965 | Herbst et al. | 148/255 |
| 3,493,440 | 2/1970 | Ashdown | 148/250 |
| 3,573,997 | 4/1971 | Plaxton | 148/255 |
| 3,899,366 | 8/1975 | Tajkowski | 427/327 |
| 3,957,543 | 5/1976 | Shinomiya et al. | 148/255 |
| 3,961,992 | 6/1976 | Jahnke et al. | 148/257 |
| 3,966,502 | 6/1976 | Binns | 148/247 |
| 4,039,353 | 8/1977 | Kulick et al. | 148/257 |
| 4,083,756 | 4/1978 | Tajkowski et al. | 427/419.2 |
| 4,110,129 | 8/1978 | Matsushima et al. | 148/255 |
| 4,220,485 | 9/1980 | Howell | 148/255 |
| 4,362,577 | 12/1982 | Jones | 148/255 |
| 4,376,000 | 3/1983 | Lindert | 148/257 |
| 4,433,015 | 2/1984 | Lindert | 427/388.4 |
| 4,514,325 | 4/1985 | Russo et al. | 252/557 |
| 4,517,028 | 5/1985 | Lindert | 148/251 |
| 4,564,397 | 1/1986 | Opsahl | 148/257 |
| 4,917,737 | 4/1990 | Carey et al. | 148/250 |

FOREIGN PATENT DOCUMENTS

| | | | |
|---|---|---|---|
| 56-163280 | 12/1981 | Japan | 148/257 |

*Primary Examiner*—Jay H. Woo
*Assistant Examiner*—James P. Mackey
*Attorney, Agent, or Firm*—Alexander D. Ricci; Steven D. Boyd

[57] ABSTRACT

A method and composition for sealing of a conversion coating is disclosed. The method includes contacting a metal substrate, to which has been applied a conversion coating, with an aqueous solution including a heterocyclic alcohol. The preferred heterocyclic alcohol is tetrahydro-2-furanmethanol. The sealer may dry in place or be followed by a water rinse.

10 Claims, No Drawings

METHOD FOR SEALING CONVERSION COATED METAL COMPONENTS

FIELD OF THE INVENTION

The present invention relates to a composition and method for sealing a conversion coating on a metal substrate. More particularly, the present invention relates to a heavy metal free, post treatment sealing rinse for a conversion coating process.

BACKGROUND OF THE INVENTION

The use of conversion coatings for the purpose of inhibiting the corrosion of a metal substrate is well known. Phosphating is a widely used form of metal pretreatment. While phosphate coatings inhibit the corrosion of the metal substrate, the porosity of a phosphate coating results in only a limited measure of protection. For this reason, a phosphatizing process is often followed by a separate rinse process in order to provide for sealing of the pores of the phosphate coating. Chromic acid based solutions have often been used as such sealing rinses for phosphate coatings in the prior art. While chromic acid solutions as sealers are effective, due to the toxicity of the chromic acid solution, waste disposal is difficult. Also, the strongly corrosive nature of a chromic acid solution complicates the storage, handling and use of such solutions.

Sealants for conversion coated metal substrates which avoid the use of chromic acid are known in the art. For example, U.S. Pat. No. 4,517,028 discloses a process employing a substituted phenol polymer for the post treatment of phosphatized or conversion coated metal surfaces. The disclosed process is also described as being effective for treating previously untreated metal surfaces such as aluminum, steel and zinc. The metal surface is treated by contacting with a solution comprising an effective amount of a soluble or dispersible polymer which is a derivative of poly-alkylphenol polymers. U.S. Pat. No. 4,433,015 discloses a composition for the treatment of metal surfaces comprising a dilute solution of a poly-4-vinylphenol derivative or an acid salt of a poly-4-vinylphenol derivative. The treatment enhances the corrosion resistance and paint adhesion characteristics of conversion coated metal surfaces when applied as a post treatment solution. U.S. Pat. No. 4,376,000 discloses a post conversion coating treatment process for metal surfaces which comprises contacting the surface with a dilute solution of poly-4-vinylphenol or the reaction product of aldehyde or ketone and poly-4-vinylphenol.

U.S. Pat. No. 4,220,485 discloses a processes for sealing a phosphatized metal component with a non chromic acid based material which comprises a phosphoric acid, a zinc compound, a heavy metal accelerator and/or crystal refiner and a phosphonate corrosion inhibitor in an aqueous solution. A non-chromate post conversion coating treatment comprising titanium and an adjuvant selected from phosphoric acid, phytic acid, tannin, the salts and esters thereof and hydrogen peroxide is disclosed in U.S. Pat. No. 4,110,129. A post conversion coating treatment containing a melamine-formaldehyde resin and preferrably a vegetable tannin is disclosed in U.S. Pat. No. 4,039,353. A zirconium containing compound is disclosed as a sealer for a conversion coating in U.S. Pat. No. 3,966,502. U.S. Pat. No. 3,493,440 discloses a post phosphate sealer comprising a dilute aqueous solution of a primary phosphate of ammonia, amines and mixtures thereof. U.S. Pat. No. 4,917,737 discloses a method and composition for sealing a phosphate conversion coating comprising contacting a phosphate conversion coating with a substituted iminodimethylene diphosphonic acid.

U.S. Pat. No. 4,514,325 discloses the use of secondary alcohols, derivatives thereof and heterocyclic primary alcohols, like tetrahydrofurfuryl alcohol as a solvent in metal cleaning and degreasing compositions.

The advantages to be gained through the use of sealers to improve the corrosion resistance of conversion coatings has been recognized, as has the objectionable properties of typical chromium compounds employed as a sealer. The most commonly described non-chromium sealers, based upon amines, tannins, aminoalkylated-poly-vinylphenol and heavy metals have not earned wide acceptance. This is principally due to the disappointing performance in retarding corrosion. Furthermore, some of the heavy metal based sealers may pose significant waste disposal problems.

SUMMARY OF THE INVENTION

The present invention provides an effective method and composition for sealing of a conversion coating. The method and composition of the present invention does not employ chromium and/or heavy metals, thus avoiding the toxicity, handling, and disposal problems of typical prior art sealing compositions. The composition of the present invention comprises an aqueous solution of a heterocyclic alcohol. The pH of the aqueous solution is preferably adjusted to a pH from about 3 to about 7. Typically, the pH is adjusted to the desired range by the addition of phosphoric acid. The composition of the present invention is applied to a conversion coated surface and preferably dried in place thereby improving the corrosion resistance of the conversion coating. The composition of the present invention may be prepared with tap water or with deionized water. For convenience, the composition of the present invention may be supplied as a concentrate to be diluted prior to application.

DETAILED DESCRIPTION OF THE PREFERRED EMBODIMENTS

In accordance with the present invention, a post conversion coating rinse is provided which comprises an aqueous solution of a heterocyclic alcohol. The aqueous solution of a heterocyclic alcohol is applied, as by spraying or immersion, to seal a conversion coating on a metal surface. The solution of the present invention has been found to be particularly effective in sealing iron and zinc phosphate coatings. The sealing solution of the present invention has been found to be particularly effective in retarding corrosion that occurs under a siccative coating such as paint or lacquer.

The aqueous solution of a heterocyclic alcohol of the present invention preferably is adjusted to a pH from about 3 to about 7 and most preferably has a pH of about from about 3.3 to about 4.0. The pH of the aqueous solution may be adjusted by the addition of an acid such as phosphoric acid. The preferred heterocyclic alcohol of the present invention is tetrahydro-2-furanmethanol (THFA).

The aqueous solution of the present invention is generally applied to a metal substrate which has been treated so as to form a conversion coating such as by iron or zinc phosphating. After the conversion coating is formed, the article is rinsed in water and a solution of the present invention applied such as by immersion. When applied by immersion, typical immersion times can range from about 2 to about 10 seconds with immersion times of about 7 seconds found to be effective. The solution of the present invention can be applied at temperatures of from ambient up to about 180° F. with temperatures of about 110° F. preferred.

Preferrably, after application of the solution of the present invention, the sealer is dried in place without rinsing as by a stream of warm air while drying in place is preferred, the solution may be rinsed as with water rinse as desired.

The invention will now be further described with reference to a number of specific examples which are to be regarded as solely illustrative, and not as restricting the scope of the invention.

EXAMPLES

The use of a heterocyclic alcohol as a post conversion coating sealer was compared to prior art post conversion coating sealers of primary phosphate amine, and an aminoalkylated polyvinylphenol. The following compositions were employed in these examples:

A: 1.0 gram/liter tetrahydro-2-furanmethanol in tap water, pH adjusted to 3.4 to 3.5 with phosphoric acid.

B: 1.0 gram/liter tetrahydro-2-furanmethanol in deionized water, pH adjusted to 3.3 to 3.6 with phosphoric acid.

C: A 0.4 percent by volume dilution in water of a concentrate comprising 20.0% monoethanolamine, 45% phosphoric acid (75%) and 35.0% tap or deionized water, pH=3.5.

D: A 0.50 grams/liter (active) of aminoalkylated polyvinylphenol, pH about 6.0.

E: 1.0 gram/liter chromic acid in tap water, pH adjusted to 3.8 to 4.0 with ammonium hydroxide.

EXAMPLE 1

Cold rolled steel test panels were cleaned in a commercial spray cleaner solution and rinsed in tap water. A commercial titanated phosphate activator solution was then applied by immersing the test panels for 20 seconds. A zinc phosphate process solution was prepared by dilution of a concentrate to provide about 16 grams per liter as orthophosphate, 3 grams per liter as nitrate, 2 grams per liter as zinc, and 0.15 grams per liter as nickel ions. Phosphoric acid and/or sodium hydroxide were added as required to maintain a pH of 3.4 to 3.6 and sodium nitrite was added as required to maintain about 0.18 grams per liter as nitrite ion. The process solution was applied to the cleaned and activated test panels for 1 minute by spraying. After formation of the conversion coating, the test panels were rinsed in tap water and a post treatment solution (compositions A–E described above) was applied by immersion of the test panels for about 7 seconds at 110° F. The test panels were dried without rinsing in a stream of warm air. The test panels were stored in a desiccator until painted with a baked on enamel (PPG white Polycron II).

The painted test panels were scribed and exposed to a salt mist of 5% NaCl in a "neutral salt fog test" for a period of 144 hours. The panels were then rated in accordance with ASTM D-1654 (10=no paint loss and 0=near total paint loss). The test results are summarized in Table 1.

TABLE I

| Bake-On Enamel: 144 Hours 5% Neutral Salt Fog Test | |
|---|---|
| Composition of Post Treatment Rinse | ASTM Rating |
| A | 8 |
| B | 9.5 |
| C (in Deionized Water) | 7 |
| C (in Tap Water | 7 |
| D | 7 |
| E | 9.5 to 10 |

EXAMPLE 2

An iron phosphate process solution was prepared from monosodium phosphate, sodium pyrophosphate, and sodium nitrate to give about 6 grams per liter as dihydrogen phosphate ion, 0.9 grams per liter as pyrophosphate ion, and 1.5 grams per liter as nitrate ion. The solution pH was maintained in the range of 4.1 to 4.3 by phosphoric acid, and sufficient surfactants were present to achieve cleaning simultaneously with phosphating. The solution was spray-applied to steel panels for 1 minute at 130° F., and then rinsed in tap water. The post treatment solution (compositions A–E described above) was applied as described in Example 1. The panels were then painted utilizing Kansas Paint and Color Co. green urethane enamel, scribed and exposed to an neutral salt fog test for a period of 72 hours. The panels were then rated in accordance with ASTM D-1654 (10=no paint loss and 0=near total paint loss). The results are summarized in Table II.

TABLE II

| Urethane Enamel: 72 Hours 5% Neutral Salt Fog Test | |
|---|---|
| Composition of Post Treatment Rinse | ASTM Rating |
| A | 4 |
| B | 3 |
| C (in Tap Water) | 2 |
| E | 5 |

As can be seen from the results in both Tables I and II, the heterocyclic alcohol, tetrahydro-2-furanmethanol when applied as a post conversion coating rinse was more effective than prior art non-chromate rinses and in some applications was as effective as a chromic acid sealer.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A process for sealing a metal surface having thereon a conversion coating which comprises: rinsing said conversion coating and thereafter contacting the conversion coated metal surface with an aqueous, chromium free acidic solution consisting essentially of tetrahydro-2-furanmethanol and phosphoric acid.

2. The process of claim 1 further including drying said tetrahydro-2-furanmethanol on said metal surface without rinsing.

3. The process of claim 1 wherein said aqueous acidic solution has a pH of from about 3 to about 7.

4. The process of claim 3 wherein said aqueous solution has a pH of from about 3.3 to about 4.0.

5. The process of claim 4 wherein the pH is adjusted by the addition of phosphoric acid.

6. A method of sealing a conversion coated metal component which comprises contacting a conversion coated metal component with a chromium free aqueous bath consisting essentially of a tetrahydro-2- furanmethanol and phosphoric acid.

7. The method of claim 6 wherein said aqueous bath has a pH of from about 3 to about 7.

8. The method of claim 7 wherein said aqueous bath has a pH of from about 3.3 to about 4.0.

9. The method of claim 6 wherein said aqueous bath is dried in place on said metal component.

10. The method of claim 6 wherein contacting with said aqueous bath is followed by a water rinse.

* * * * *